US007191579B2

(12) United States Patent
Bartholf et al.

(10) Patent No.: US 7,191,579 B2
(45) Date of Patent: Mar. 20, 2007

(54) SHIPPING DEVICE AND METHOD FOR ARTICLES CAPABLE OF RELEASING GAS CONTAINING HAZARDOUS PARTICULATES

(76) Inventors: Joel Bartholf, 3549 Westhaven Dr., Macon, GA (US) 31206; Dennis Ruth, 161 Cambridge Way, Macon, GA (US) 31220

( * ) Notice: Subject to any disclaimer, the term of this patent is extended or adjusted under 35 U.S.C. 154(b) by 254 days.

(21) Appl. No.: 10/659,082

(22) Filed: Sep. 10, 2003

(65) Prior Publication Data

US 2004/0079667 A1 Apr. 29, 2004

Related U.S. Application Data

(60) Provisional application No. 60/410,985, filed on Sep. 16, 2002, provisional application No. 60/409,674, filed on Sep. 10, 2002.

(51) Int. Cl.
*B65B 11/48* (2006.01)

(52) U.S. Cl. ..... 53/460; 53/467; 53/482

(58) Field of Classification Search ..... 53/266.1, 53/460, 467, 468, 469, 482; 340/571; 229/307, 229/313, 80, 80.5, 83
See application file for complete search history.

(56) References Cited

U.S. PATENT DOCUMENTS 3,053,416 A * 9/1962 Harner ..... 340/571
3,564,525 A * 2/1971 Robeson et al. ..... 340/571
4,714,595 A * 12/1987 Anthony et al. ..... 206/439
5,002,220 A * 3/1991 Safranski ..... 229/80
5,059,949 A * 10/1991 Caparoni et al. ..... 340/571
5,196,828 A * 3/1993 Keniston ..... 340/568.7
5,388,388 A * 2/1995 Belec et al. ..... 53/460
5,485,143 A * 1/1996 Keniston ..... 340/571
5,503,328 A * 4/1996 Roccaforte et al. ..... 229/80
5,524,802 A * 6/1996 Benson et al. ..... 224/194
5,683,795 A * 11/1997 Ambrose et al. ..... 442/381
5,952,920 A * 9/1999 Braddick ..... 340/571
5,976,299 A * 11/1999 Ivey ..... 156/270
6,032,854 A * 3/2000 Greer et al. ..... 229/80
6,070,728 A 6/2000 Overby et al.
6,070,792 A * 6/2000 Foushee ..... 229/80
6,552,660 B1 * 4/2003 Lisowski ..... 340/571

FOREIGN PATENT DOCUMENTS

DE 198 43 430 A1 3/2000
EP 0 551 853 A1 7/1993

OTHER PUBLICATIONS

"Notice 71: Bombs by Mail" United States Postal service, Feb. 1998.*
"Bishop Sentenced to 18 Years for Mail Bomb Incident" United States Attorney's Office, Jul. 2002.*
"Mail Center Security" United States Postal Service, Dec. 2001.*
International Search Report dated Dec. 18, 2003 to application No. PCT/US03/28271 (corresponding PCT application).

* cited by examiner

*Primary Examiner*—Louis Huynh
(74) *Attorney, Agent, or Firm*—RatnerPrestia

(57) ABSTRACT

An enclosure for shipping an article capable of releasing a combination of gas and particulates. The enclosure comprises a material of construction, such as spun bold polyolefin, adapted to allow escape of the gas from the enclosure while retaining the particulates. The enclosure, which is sized to contain the article, has no breaches capable of allowing escape of the particulates, except for an opening at the top end. The opening is adapted to be sealed in a closed configuration, which may comprise one or more pinch lines, that prevents escape of the particulates. In one embodiment the enclosure may be in the form of an envelope having adhesive on a front face and a back face thereof to facilitate securing the top of the envelope after folding along a plurality of pinch lines. The enclosure may be particularly useful in a method for shipping a currency anti-theft device.

8 Claims, 2 Drawing Sheets

SHIPPING DEVICE AND METHOD FOR ARTICLES CAPABLE OF RELEASING GAS CONTAINING HAZARDOUS PARTICULATES

CROSS-REFERENCE TO RELATED APPLICATIONS

This application claims priority from U.S. Provisional Application No. 60/409,674, filed Sep. 10, 2002, and from U.S. Provisional Application No. 60/410,985, filed Sep. 16, 2002, both of which are incorporated herein by reference.

FIELD OF THE INVENTION

This invention relates to methods and systems for shipment of goods. More particularly, it relates to a method and system for the shipment of articles, such as currency theft protection devices, capable of releasing gas and particulate matter, such as smoke, dye, and/or tear gas, during shipment.

BACKGROUND OF THE INVENTION

Transportation of explosive devices are regulated under hazardous materials safety regulations. For example, shipment of currency anti-theft devices, such as SecurityPac® Electronic Protection Systems, manufactured and distributed by 3SI Security Systems (formerly known as ICI Security Systems), exemplary devices of which are described by U.S. Pat. No. 5,059,949 to Caparoni et al., incorporated herein by reference, have historically been governed by hazardous materials regulations because of the pyrotechnic nature of the devices. Such devices, used by banks and others in the currency shipment business for thwarting attempted theft, typically include a pyrotechnic actuator that ignites a dye formulation which discharges a mixture of smoke and dye for the purpose of staining/recovering stolen bank notes. The devices are subject to these regulations even though the devices require a battery to activate the actuator and are shipped separately from the batteries.

Some devices also contain tear gas. As is commonly known in the art, the substances most often used as tear gases are not true gases under ordinary conditions, but are liquids or solids that are dispersed as airborne particles when the alarm pack is activated. Commonly known tear gas substances include but are not limited to CS (chlorobenzylidene malononitrile), CN (chloroacetophenone) (also known as "Mace"), and Pepper Spray (typically containing oleoresin capsicum (OC), which is the active ingredient in cayenne pepper).

Shipping of such anti-theft devices has traditionally been regulated under United States Department of Transportation (US DOT) hazardous materials safety regulations, specifically under hazard classification 1.4G, as set forth in 49 CFR 173.52. Other countries have similar shipping regulations.

49 CFR 173.52 describes compatability group G as a "Pyrotechnic substance or article containing a pyrotechnic substance, or article containing both an explosive substance and an illuminating, incendiary, tear-producing or smoke-producing substance (other than a water-activated article or one containing white phosphorus, phosphide or flammable liquid or gel or hypergolic liquid)."

Shipping regulated materials is typically more expensive than shipping non-regulated materials and therefore it is desirable to seek an exemption from hazardous shipping regulations.

SUMMARY OF THE INVENTION

One aspect of the invention comprises an enclosure for shipping an article capable of releasing a combination of gas and particulates, the enclosure comprising a material of construction adapted to allow escape of the gas from the enclosure while retaining the particulates within the enclosure, sized to contain the article, and having no breaches capable of allowing escape of the particulates except for an opening at the top end, the opening adapted to be sealed in a closed configuration adapted to prevent escape of the particulates. The enclosure may be defined by at least a front face and a back face, the closed configuration comprising at least one pinch line distal of the opening, each pinch line comprising a line along which at least the front face and the back face are both folded or rolled 180 degrees. As used herein, the term "distal" refers to a direction toward the bottom of the enclosure, whereas the term "proximal" refers to a direction toward the top of the enclosure.

In one embodiment, the enclosure comprises an envelope for shipping a currency anti-theft device, capable of releasing particulates such as smoke, dye, active ingredients of tear gas, or a combination thereof. The envelope may comprise spun bond polyolefin and may have a front face, a back face, a top end, a bottom end, and an opening at the top end. The front face has an outward-facing side, an inward-facing side, and a flap that extends proximally beyond the back face in the open configuration. The flap may comprise a first area of adhesive on the inward-facing side for adhering to the back face when the flap is folded over at a first pinch line to close off the opening. The front face may further comprise at least a second area of adhesive on the outward-facing side for adhering to the back face when a top portion of the closed envelope is folded over again at another pinch line.

The second area of adhesive may be located in a position such that the envelope, after folding over the flap at the first pinch line in a first direction, is adapted to be folded again in the first direction on a second pinch line, and then folded an additional time in the first direction on a third pinch line to position the second area of adhesive for adhering to the back face. The envelope may further comprise a secured bottom opening and a secured longitudinal seam, the secured bottom opening comprising a bottom pinch line that pinches closed the bottom opening and forms a bottom edge of the envelope.

Another aspect of the invention comprises a method for shipping an article capable of releasing a combination of gas and particulate. The method comprises providing an enclosure comprising a material of construction adapted to allow escape of the gas from the enclosure while retaining the particulates within the enclosure, sized to contain the article, and having no breaches capable of allowing escape of the particulates except for an opening at the top end. The article is inserted in the enclosure; and the top end is sealed in a closed configuration adapted to prevent escape of the particulates. The enclosure may be defined by at least a front face and a back face, in which case the method may comprise sealing the top end in the closed configuration by forming at least one pinch line distal of the opening, each pinch line comprising a line along which at least the front face and the back face are both folded or rolled 180 degrees. In particular, the method may be used to enable shipment of the article pursuant to an exemption from a hazardous shipping regulation.

In one embodiment of the method, the enclosure comprises an envelope having an open configuration, a closed configuration, a front face, a back face, a top end, a bottom end and an opening at the top end, the front face having an outward-facing side and an inward-facing side, and the envelope comprises a flap that extends proximally beyond the back face in the open configuration. The article is inserted in the envelope, and the flap is folded over in a first direction at a first pinch line to close off the opening, the first pinch line positioned distally of the opening so that both the front face and the back face are folded when the flap is folded over. The flap is fastened to the back face. Then, a top portion of the closed envelope may be folded over one or more additional times in the first direction and the folded top portion fastened to the back face.

Another aspect of the invention comprises a method for shipping a currency anti-theft device having a pyrotechnic actuator and capable of suddenly releasing a combination of gas and particulates, the particulates comprising smoke, dye, active ingredients of tear gas, or a combination thereof. The method comprises the steps of providing an envelope comprising spun bond polyolefin, capable of enclosing the article, and having a front face, a back face, a top end, a sealed bottom end, and an opening at the top end, and having an open configuration and a closed configuration, the front face having an outward-facing side, an inward-facing side, and a flap that extends proximally beyond the back face in the open configuration. The flap comprises a first area of adhesive protected by a first removable covering on the inward-facing side of the flap. The article is inserted in the envelope. The flap is folded over in a first direction at a first pinch line to close off the opening, the first pinch line positioned distal of the opening so that both the front face and the back face are folded when the flap is folded over. The first removable covering is removed from the first area of adhesive, and the flap is fastened to the back face. A top portion of the closed envelope is folded over on a second pinch line that causes a crease in the front face, the back face, and a portion of the flap; and then the top portion is folded over an additional time in the first direction on a third pinch line. A second removable covering is removed from a second area of adhesive on the front face, and the folded top portion is fastened to the back face.

Yet another aspect of the invention comprises an enclosure having an open configuration and a closed configuration, the enclosure adapted, in the closed configuration, to allow gas to escape the enclosure while retaining essentially all liquid or solid particulate within the enclosure, the enclosure comprising spun bonded polyolefin and having a front face, a back face, a bottom opening secured in a pinched closed configuration, and a top opening, the enclosure comprising means for securing the top opening in a pinched closed configuration comprising at least one pinch line distal of the top opening along which at least the front face and the back face are both folded or rolled.

DETAILED DESCRIPTION OF THE INVENTION

Figure 1:
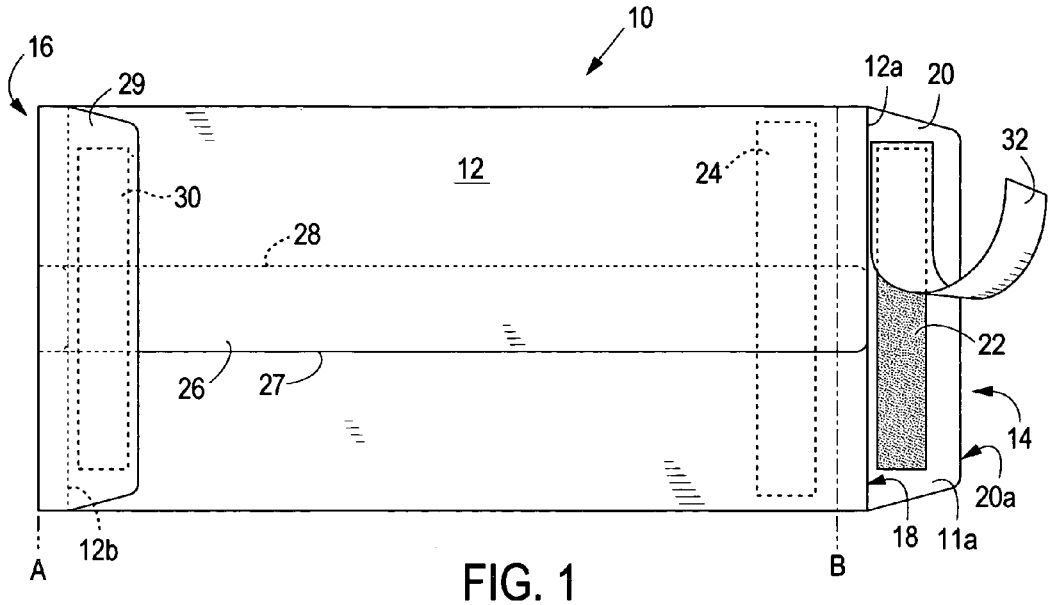
FIG. 1 depicts an exemplary envelope of the present invention.

Referring now to the figures, it has been found, surprisingly, that shipping currency anti-theft devices comprising dye packs in spun bond polyolefin packaging can completely contain the solid or liquid smoke, dye, and/or tear gas particles generated by activation of the devices, while at the same time permitting any gas produced during activation to escape the packaging. Because of the highly effective manner in which spun bond polyolefin packaging filters the associated mixture of smoke, dye, and tear gas particles, such a containment system virtually eliminates the hazard risk from an air contaminant perspective. Therefore, use of this highly effective packaging system has allowed exemption from U.S. hazardous materials shipping regulations for the assignee's currency theft protection devices.

Although spun bond polyolefin material, such as TYVEK® spun bond polyolefin, manufactured by the DuPont company of Wilmington, Del., is a preferred material, any equivalent type of material that effectively provides filtration of the smoke and dye mixture may be used.

A preferred containment system comprises a bag or envelope that enables rolling or folding of the top to create an effective seal and that also has an effectively sealed bottom flap to prevent leakage. An exemplary such envelope 10 is shown in FIGS. 1–4. Envelope 10 has a front face 11, a back face 12, a top end 14, a bottom end 16, and an opening 18 at the top end. The envelope has an open configuration (shown in FIG. 1) and a closed configuration (shown in FIG. 2). Front face 11 has an outward-facing side 11*b*, an inward-facing side 11*a*, and a top flap 20 that extends topward beyond the top edge 12*a* of back face 12 in the open configuration. Top flap 20 comprises a first area of adhesive 22 on the inward-facing side, typically with a removable, protective strip 32 for covering the adhesive, shown in FIG. 1 in a partially removed state. Front face 11 has a second area of adhesive 24 (shown in dashed lines in FIG. 1) on the outward-facing side 11*b*. An exemplary adhesive may comprise, for example, an acrylic adhesive, such as sold under the tradename HM-138 by the AccuBond Corporation of Downingtown, Pa., although the invention is not limited to any particular type of adhesive.

The envelope may be constructed from a single sheet of spun bond polyolefin that has been cut and folded to create the shape shown in FIG. 1. In particular, back face 12 comprises portions of the sheet that have been folded over one another and fastened together, such as with adhesive (not shown, to reduce clutter in the figures), leaving a sealed seam 26 located between longitudinal edges 27 and 28 of the folded-over portions, one edge (26) hidden and the other edge (27) exposed. Bottom flap 29 (similar to top flap 20) is folded over at pinch line A, which then forms the bottommost edge of the envelope. Pinch line A is positioned such that both front face 11 and back face 12 are folded along line A. Bottommost edge 12*b* (prior to folding over bottom flap 29) of back face 12 is shown in dashed lines and is the entry point for a bottom opening (not shown). A third area of adhesive 30 (shown in hidden lines) fastens bottom flap 29 to back face 12. Thus, the envelope is typically manufactured and provided to the user with seam 26 and bottom flap 29 secured and with removable coverings 32 and 34 provided over adhesive sections 22 and 24, respectively.

Figure 2:
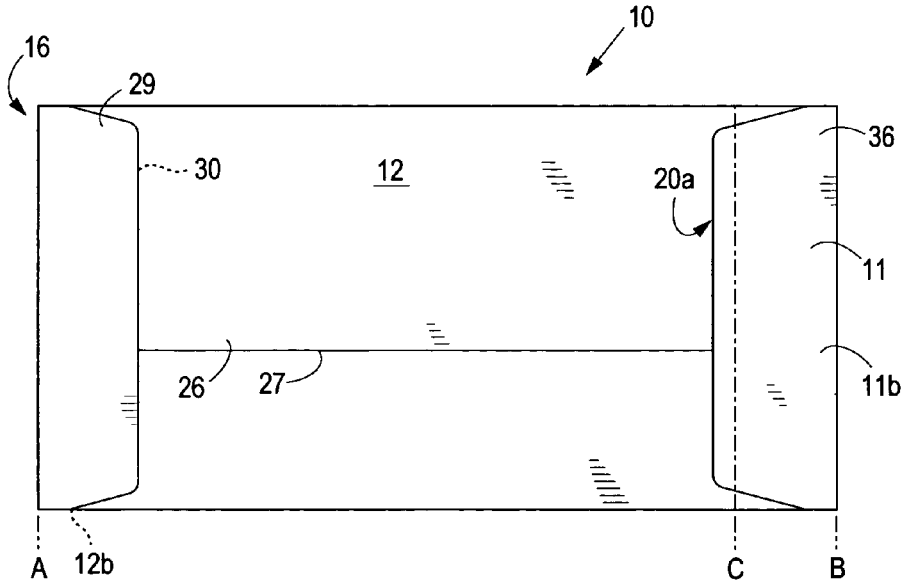
FIG. 2 depicts the envelope of FIG. 1 after a first exemplary folding step.

For shipment of a device in the envelope, the device is inserted into the envelope, strip 32 over adhesive 22 is removed, and flap 20 is then folded distally (toward the bottom end) along pinch line B until adhesive 22 contacts back face 12 the envelope, creating a seal. It should be noted that pinch line B is located distal the topmost edge 12*a* of back face 12, such that both back face 12 and front face 11 are folded when the flap is folded along pinch line B. This is important, because folding over both back face 12 and front face 11 pinches off opening 18. Folding at or proximal (toward the top end) topmost edge 12*a* does not pinch off opening 18 and does not create as effective a seal. The folded envelope is shown in FIG. 2. To minimize clutter in the drawing, FIGS. 2–4 do not show hidden lines.

Figure 3:
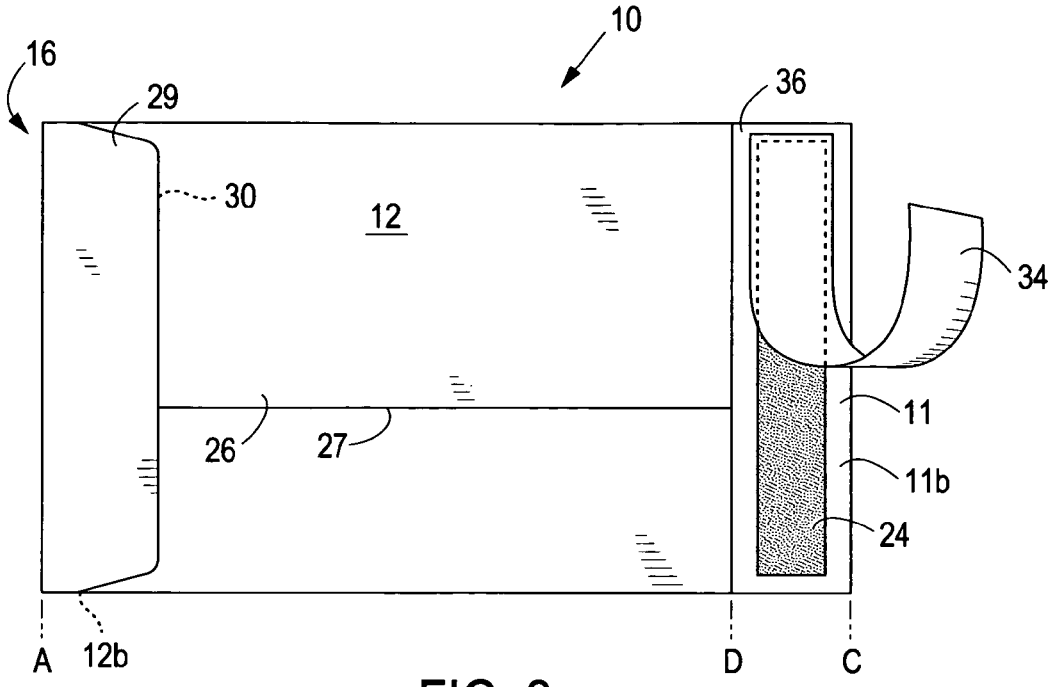
FIG. 3 depicts the envelope of FIG. 2 after a second exemplary folding step.
Figure 4:
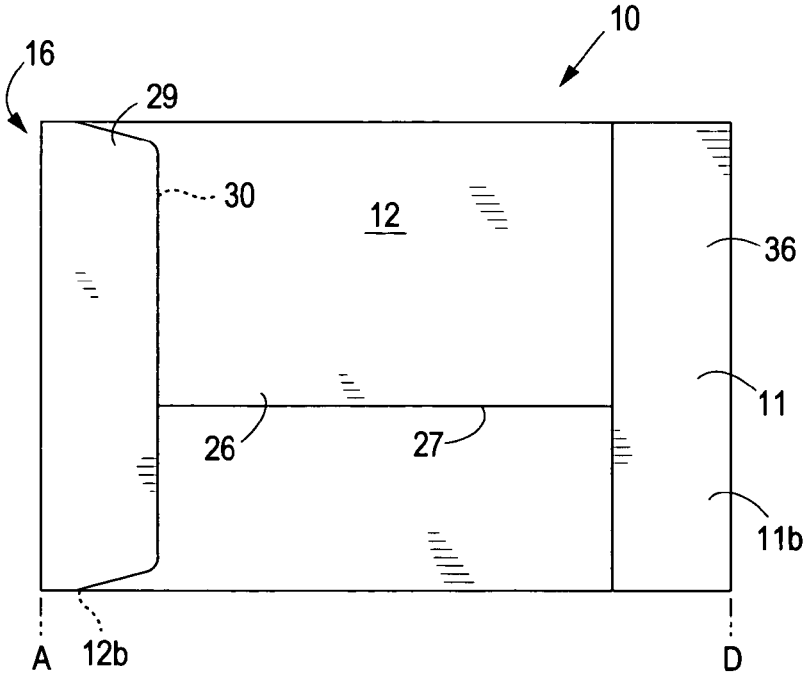
FIG. 4 depicts the envelope of FIG. 3 after a third exemplary folding step.

Although a single pinch line may be adequate to prevent escape of particulates, to maximize the effectiveness of the seal, additional folds are desirable. Next, top portion 36 of envelope 10 is folded again distally along pinch line C. It should be noted that pinch line C as shown in FIG. 2 is located proximal top edge 20*a* of folded-over flap 20, so that front face 11, back face 12, and flap 20 are all folded when the envelope is folded along pinch line C. Pinch line C may also be positioned distal top edge 20*a* so that flap 20 is not folded, if desired. Folding along pinch line C brings adhesive 24 into a position to stick to back face 12 when the top portion 36 is folded again in the distal direction along pinch line D, as shown in FIG. 3. Thus, the removable 34 covering over adhesive 24 is removed, and the top portion 36 of envelope 10 is folded again distally, enabling adhesive 24 to stick to back face 12 to seal the envelope in the folded position, as shown in FIG. 4. because of the one or more pinch lines, the folded end of envelope 10 creates a seal that does not leak smoke, dye, and/or teargas particulates in the unlikely event that a currency theft prevention device (not shown) contained inside the envelope is discharged.

Although shown in a preferred embodiment, additional folds and additional adhesive strips may also be provided, as desired. It should also be noted that although referred to as an "envelope" in an exemplary embodiment, the enclosure may be in the form of a bag or any other structure conducive to being folded or rolled to create pinch lines. Also, while shown with discrete folds being used to seal the top of the envelope, the top of the envelope may be rolled instead, in which case a pinch line is defined by a roll of 180 degrees. Additionally, although an acrylic adhesive with removable coverings is shown in the figures, such that removal of the strips activates the adhesive (makes it available to stick to another surface) other types of adhesive may also be used, such as adhesives that requires activation by application of another component, such as water or some other liquid.

It should also be understood that the dimensions of the containment system, the location of the pinch lines, and the number of folds are not critical, so long as multiple pinch lines and sufficient adhesive area(s) is/are provided to create a leakproof seal. In preferred embodiments, however, the location of the pinch line B is distal of the topmost edge 12*a* and the location of pinch line A is proximal (prior to folding over) of bottommost edge 12*b* of the back face as shown in FIG. 1 so that the respective openings of the envelope are actually pinched off, unlike traditional mailing envelopes that are just closed by a similarly-structured flap. These folds that introduce pinch lines are important for providing a leakproof seal with a minimal number of folds or rolls. Also, the location of each subsequent pinch line is preferably oriented relative to the other-adhesive locations so that entire surface area of the adhesive is available for sticking to the bag or envelope when rolled or folded into place. Thus, precise locations of the adhesive and dimensions of the bag or envelope may be adjusted to fit the specific application.

Thus, in the exemplary embodiment, the adhesive is provided in a first location, such as the flap, which provides a first seal when the flap is folded over at a pinch line, and in a second location that provides a second seal after rolling or folding the top of the bag at least one more time. Preferably at least two additional pinch lines formed by folding in the same direction as the first fold are made before adhesive 24 seals the top portion 36 of the envelope. Designs adapted to provide more than or less than two additional pinch lines may also be provided.

Testing of the exemplary embodiment have confirmed that this packaging method allows gases released during activation to escape, while at the same time completely containing the smoke, dye, and tear gas particles within the envelope. In tests in which 12 dye packs were separately packaged in individual envelopes of the present invention as described herein and the individual envelopes boxed together, activation of all 12 dye packs in the closed box left no visible effects exterior to the box, and left the interior of the box free and clear of any visible evidence of dispersed dye. Comprehensive air sampling demonstrated ambient air quality levels to be well below acceptable air quality limits set by the U.S. Occupational Health and Safety Administration (OSHA) for respirable particulate, total particulate, and CS tear gas. The effectiveness of the system and method of the exemplary embodiment disclosed herein has thus been analytically proven and is fully recognized by the appropriate regulatory agencies, resulting in an exemption from hazardous shipping regulations by the U.S. DOT through issuance of an appropriate Ex-Number that prescribes use of the exemplary spun bond polyolefin packaging system disclosed herein.

Thus, this invention covers a shipping container for articles, such as currency dye packs, that contain pyrotechnic substances in conjunction with particulate-producing substances. The shipping container preferably comprises a bag or envelope made of a material, such as spunbond polyolefin, capable of filtering out the particulate-producing substance from any gas released during activation of the article. The envelope as received ready for use preferably comprises a bottom flap 29 and a longitudinal seam 26 that are pre-sealed, and a top flap 20 comprising a first adhesive strip 22 covered with a first removable covering 32. A second adhesive strip 24 covered with a second removable covering 34 is also provided to fasten a folded portion of the envelope after being folded over a total of, preferably, at least three times, including the fold in which the first adhesive strip 22 makes contact with the envelope after removal of the covering 32.

Although described in connection with an envelope for shipping currency theft prevention devices, the invention may take the form any enclosure 10 comprising spun bonded polyolefin or other material with filtration capabilities adapted to be manipulated into a closed configuration that allows gas to escape the enclosure while retaining liquid or solid particulates within the enclosure. The enclosure can generally be described as having a front face 11, a back face 12, a bottom opening secured in a pinched closed configuration ("pinched closed" meaning that both the front face and back face are folded, such as along pinch line A), and a top opening 18. Enclosure 10 comprises structure for securing the top opening in a pinched closed configuration comprising at least two pinch lines (pinch lines B, C, and D, each of which is essentially a 180 degree turn of both the front face 11 and back face 12) distal of the top opening 18 in which at least the front face 11 and the back face 12 are both folded or rolled.

As shown in FIG. 1, one exemplary structure for securing the top opening comprises flap 20 and adhesive strips 22 and

24. In other designs, however, the flap may be omitted, and one strip of adhesive supplied on front face 11 and another on back face 12, such that essentially folds along pinch lines C and D are sufficient to close the envelope. Although it is desirable to provide two strips of adhesive, a single strip of adhesive may be provided to secure only the final fold. In a rolled design, a single large adhesive area may be provided on the front face with a key (similar to that provided with a sardine can) provided for rolling the bag distally until the end of the adhesive area is reached, with each 180 degree roll of the front and back faces together comprising a "pinch line." In another design, rather than providing adhesive pre-attached to the envelope, tape may be used to secure the bag after one or more of the folds.

Although various embodiments of the invention have been described, it will be understood that the invention is not limited to these embodiments, but is capable of numerous modifications of parts, elements and materials without departing from the invention. What is essential is that the enclosure comprise a material of construction adapted to allow escape of the gas from the enclosure while retaining the particulates within the enclosure, and that when fully sealed with the article inside, there are no breaches in the enclosure capable of allowing escape of the particulate. Although exemplary embodiments have been shown, numerous other embodiments can be provided having these same essential characteristics.

What is claimed is:

1. A method for shipping an article capable of releasing a combination of gas and particulates, the method comprising the steps of:

(a) providing an enclosure comprising a material of construction adapted to allow escape of the gas from the enclosure while retaining the particulates within the enclosure, sized to contain the article, said enclosure further comprising a front side, a back side, a closed bottom end, said bottom end comprising a folded over portion wherein a portion of the enclosure is folded over thereby to form a sealed bottom end and thereby prevent escape of the particulates therethrough, and a sealable top end comprising an open top, said sealable top end comprising a foldable flap portion extending past said open top adapted to be folded over said open top, said flap comprising a first adhesive strip on an inside surface thereof, the enclosure further comprising a second adhesive strip located on an outer surface of said back side at a position bellow said open top;

(b) inserting the article in the enclosure; and (c) sealing the top end in a closed configuration adapted to prevent escape of the particulates by first folding said flap over said open top and adhering said first adhesive strip to an outer surface of said front side closing said top end, then folding said closed top end of said enclosure over said front side of said enclosure at least once and adhering said second adhesive strip on said outer surface of said back side to said front side of said enclosure.

2. The method of claim 1, wherein at least one of said first and second adhesive strips comprises a removable covering over the adhesive, the step of adhering the adhesive strip comprising removing the removable covering.

3. The method of claim 1, wherein the enclosure comprises spun bond polyolefin.

4. The method of claim 1, wherein the article comprises a pyrotechnic actuator.

5. The method of claim 1, wherein the article comprises a currency anti-theft device.

6. The method of claim 1, wherein the article is capable of releasing particulates comprising smoke, dye, active ingredients of tear gas, or a combination thereof.

7. The method of claim 6, wherein the article is capable of releasing particulates comprising active ingredients of tear gas selected from: chlorobenzylidene malonitrile (CS); chloroacetophenone (CN or "mace"); and oleoresin capsicum (OC or "pepper spray").

8. The method of claim 1, wherein the method is used to enable shipment of the article pursuant to an exemption from a hazardous shipping regulation.

* * * * *